US010928065B2

(12) United States Patent
Corti et al.

(10) Patent No.: US 10,928,065 B2
(45) Date of Patent: Feb. 23, 2021

(54) GAS BURNER CONTROLLER ADAPTER, GAS BURNER APPLIANCE HAVING SUCH A GAS BURNER CONTROLLER ADAPTER AND METHOD FOR OPERATING SUCH A GAS BURNER APPLIANCE

(71) Applicant: Honeywell Technologies Sarl, Rolle (CH)

(72) Inventors: Umberto Corti, Valmadrera (IT); Volker Kleine, Bissendorf (DE)

(73) Assignee: Honeywell Technologies Sarl, Rolle (CH)

( * ) Notice: Subject to any disclaimer, the term of this patent is extended or adjusted under 35 U.S.C. 154(b) by 600 days.

(21) Appl. No.: 15/832,406

(22) Filed: Dec. 5, 2017

(65) Prior Publication Data

US 2018/0156452 A1 Jun. 7, 2018

(30) Foreign Application Priority Data

Dec. 6, 2016 (EP) ..... 16202335

(51) Int. Cl.

| | |
|---|---|
| ***F23D 14/60*** | (2006.01) |
| ***F23D 17/00*** | (2006.01) |
| ***F23Q 13/02*** | (2006.01) |
| ***F23N 5/12*** | (2006.01) |
| *F24C 3/12* | (2006.01) |

(52) U.S. Cl.

CPC ..... *F23D 14/60* (2013.01); *F23D 17/002* (2013.01); *F23N 5/123* (2013.01); *F23Q 13/02* (2013.01); *F23D 2208/00* (2013.01); *F23N 2227/36* (2020.01); *F23N 2229/12* (2020.01); *F24C 3/12* (2013.01)

(58) Field of Classification Search

CPC ..... F23D 14/60; F23D 17/002; F23N 5/123

See application file for complete search history.

(56) References Cited

U.S. PATENT DOCUMENTS

| | | | | |
|---|---|---|---|---|
| 3,614,280 | A | 10/1971 | Yamaguchi | |
| 4,015,928 | A | 4/1977 | Carlson | |
| 4,177,033 | A | 12/1979 | Wallace | |
| 4,382,770 | A | 5/1983 | Pinckaers | |
| 5,636,978 | A | 6/1997 | Sasaki | |
| 6,222,719 | B1 | 4/2001 | Kadah | |
| 10,151,492 | B2 * | 12/2018 | Huang | F24C 3/103 |
| 2012/0288806 | A1 * | 11/2012 | Racaj | F23N 5/123 431/18 |
| 2013/0330675 | A1 | 12/2013 | Strong | |
| 2017/0038071 | A1 * | 2/2017 | Strong | F23N 5/123 |
| 2018/0156452 | A1 | 6/2018 | Corti et al. | |

FOREIGN PATENT DOCUMENTS

EP 1039226 A2 9/2000

OTHER PUBLICATIONS

Extended Search Report from counterpart European Application No. 16202335.2, dated May 24, 2017, 5 pp.

Intent to Grant and Text Intended to Grant dated Apr. 9, 2019, from counterpart European Application No. 16202335.2, 52 pp.

* cited by examiner

*Primary Examiner* — Scott Bauer

(74) *Attorney, Agent, or Firm* — Shumaker & Sieffert, P.A.

(57) ABSTRACT

A gas burner controller adapter for use in adapting a gas burner control device, which is configured to be connected to a flame ionization electrode and a separate ignition electrode, to operate in a gas burner that only includes a single electrode serving as both the flame ionization electrode and the ignition electrode.

20 Claims, 5 Drawing Sheets

GAS BURNER CONTROLLER ADAPTER, GAS BURNER APPLIANCE HAVING SUCH A GAS BURNER CONTROLLER ADAPTER AND METHOD FOR OPERATING SUCH A GAS BURNER APPLIANCE

This application claims priority to European Patent Application No. 16 202 335.2, filed Dec. 6, 2016 and entitled, "GAS BURNER CONTROLLER ADAPTER, GAS BURNER APPLIANCE HAVING SUCH A GAS BURNER CONTROLLER ADAPTER AND METHOD FOR OPERATING SUCH A GAS BURNER APPLIANCE," which is incorporated herein by reference.

TECHNICAL FIELD

The present patent application relates to a gas burner controller adapter. Further on, the invention relates to a gas burner appliance having such a gas burner controller adapter and to a method for operating such a gas burner appliance.

BACKGROUND

Gas burner appliances comprise a burner chamber. A gas/air mixture can be combusted or burned within said burner chamber when the gas burner and thereby the gas/air mixture is ignited. Gas burner appliances further usually comprise a heat exchanger being positioned within the burner chamber for heating water by combusting or burning said gas/air mixture within said burner chamber. The water entering into the heat exchanger is often called return-flow water and the water exiting the heat exchanger is often called forward-flow water. Gas burner appliances further comprise an air pipe or air duct for providing the air of the gas/air mixture, a gas pipe or gas duct for providing the gas of the gas/air mixture and an exhaust pipe or exhaust duct through which exhaust flowing out of the burner chamber can emerge into the ambient of the gas burner. Gas burner appliances also comprise a fan being assigned to the exhaust pipe or the air pipe and a gas valve being assigned to the gas pipe. Gas burner appliances further comprise an ignition electrode for igniting the gas/air mixture and a flame ionization electrode for providing a measurement signal. Gas burner appliances also comprise a gas burner control device for controlling the operation the gas burner appliance, preferably for controlling the fan and/or the igniter on basis of a signal provided by the flame ionization electrode.

Such gas burner appliances are differentiated between gas burner appliances making use of an ignition electrode and a flame ionization electrode provided as separate electrodes, and gas burner appliances making use of a single electrode serving as flame ionization electrode and as ignition electrode. Both types of gas burner appliances use special gas burner control devices acting together with the single electrode or with the two separate electrodes. A key advantage of gas burner appliances making use of two separate electrodes, namely of one ignition electrode and of one flame ionization, is the more accurate flame ionization measurement during ignition phases of the gas burner appliance. However, gas burner appliances making use a single electrode are more cost effective.

SUMMARY

Against this background, a novel gas burner controller adapter is provided that allows the use of a single electrode serving as flame ionization electrode and as ignition electrode in connection with a gas burner control device that is adapted to act together with two separate electrodes. Further on, a gas burner appliance having such a gas burner controller adapter and method for operating such a gas burner appliance are provided.

The gas burner controller adapter comprises a first connection terminal through which the same is connectable to a gas burner control device, namely to an input/output terminal of the gas burner control device that is adapted to receive a voltage signal of a flame ionization electrode.

The gas burner controller adapter further comprises a second connection terminal through which the same is connectable to the gas burner control device, namely to an output terminal of the gas burner control device that is adapted to provide a first electrical voltage signal.

The gas burner controller adapter further comprises a third connection terminal through which the same is connectable to the gas burner control device, namely to another output terminal of the gas burner control device that is adapted to provide a second electrical voltage signal.

The gas burner controller adapter further comprises a fourth connection terminal through which the same is connectable to a single electrode which is used as ignition electrode and in addition as flame ionization electrode.

The gas burner controller adapter further comprises a DC/DC converter and an igniter having a transfer coil and an ignition coil.

Input terminals of DC/DC converter are connected to the second connection terminal and to the third connection terminal. Output terminals of the DC/DC converter are connected to the transfer coil of the igniter through a capacitor and through a thyristor. The ignition coil of the igniter is connected to the fourth connection terminal and to the first connection terminal.

Such a gas burner controller adapter allows to make use of a single electrode serving as flame ionization electrode and as ignition electrode in connection with a gas burner control device that is adapted to act together with two separate electrodes.

Preferably, a cathode of the thyristor is connected to one of the output terminals of the DC/DC converter and to a capacitor which is connected between the two output terminals of the DC/DC converter as well as between the cathode of the thyristor and the transfer coil. An anode of the thyristor is connected to the transfer coil of the igniter. A gate of the thyristor is connected to a fifth connection terminal of the adapter through which the adapter is connectable to the gas burner control device, namely to another output terminal of the gas burner control device that is adapted to provide a third electrical voltage signal. Such a gas burner controller adapter allows to use a single electrode serving as flame ionization electrode and as ignition electrode in connection with a gas burner control device that is adapted to act together with two separate electrodes. The fifth connection terminal is either directly connected to a gate of the thyristor or indirectly connected to a gate of the thyristor through a synchronization circuit.

During ignition phases the ignition coil is also connected to ground through an overvoltage limiter. The overvoltage limiter is connected between the first connection terminal and the output terminal of the DC/DC converter to which the cathode of the thyristor is connected.

BRIEF DESCRIPTION OF THE DRAWINGS

The following description should be read with reference to the drawings. The disclosure may be more completely understood in consideration of the following description with respect to various examples in connection with the accompanying drawings, in which.

DESCRIPTION

Figure 1:
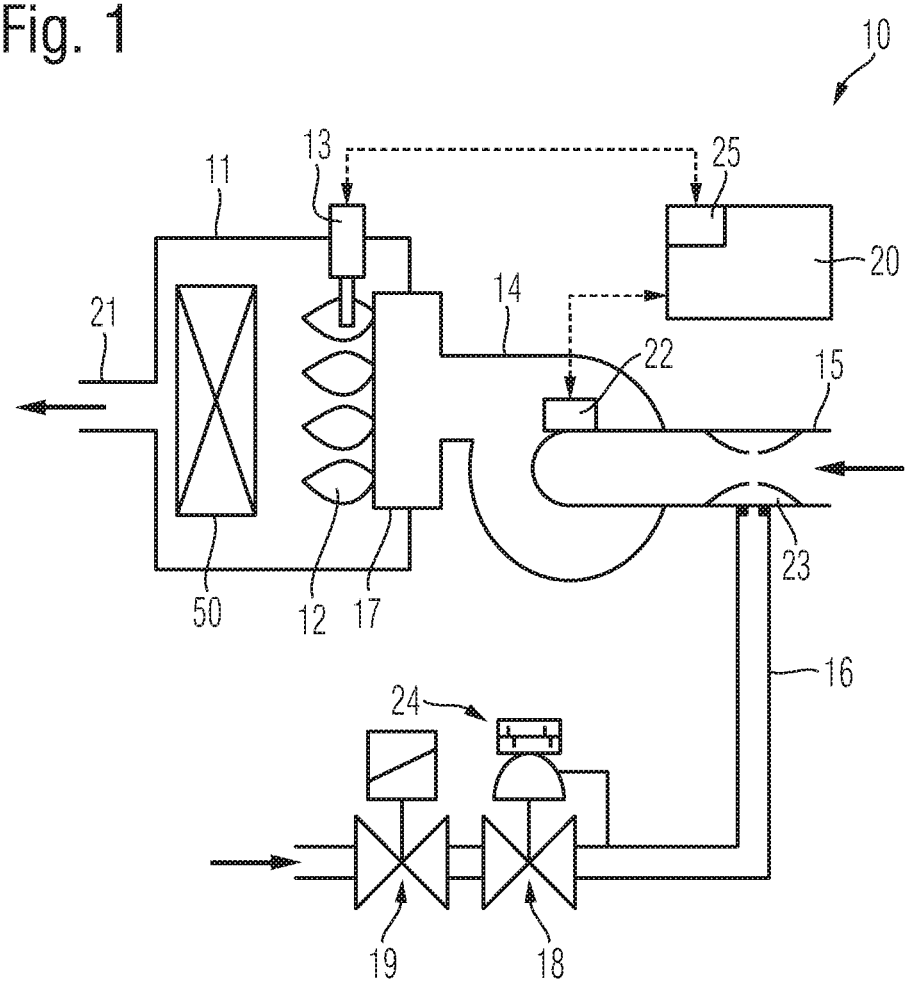
FIG. 1 shows a schematic view of a gas burner appliance.

FIG. 1 shows a schematic view of an exemplary gas burner appliance 10. The gas burner appliance 10 comprises a gas burner chamber 11 with a gas burner surface 17 in which combustion of a gas/air mixture having a defined mixing ratio of gas and air takes place during burner-on phases of the gas burner. The combustion of the gas/air mixture results into flames 12 monitored by a flame ionization electrode 13. The electrode 13 serves also as ignition electrode to ignite the gas/air mixture. So, the gas burner appliance 10 uses a single electrode 13 serving as ignition electrode and as flame ionization electrode.

The defined gas/air mixture is provided to the burner chamber 11 of the gas burner by mixing an air flow with a gas flow. A fan 14 sucks in air provided by an air duct 15 and further sucks in gas provides by a gas duct 16. A gas regulating valve 18 for adjusting the gas flow through the gas duct 16 and a gas safety valve 19 are assigned to the gas duct 16. Exhaust resulting from the combustion of the gas/air mixture flows out of the burner chamber through an exhaust pipe 21.

Thermal energy resulting from the combustion may be used to heat water flowing through a heat exchanger 50 of the gas burner appliance 10. The defined gas/air mixture having the defined mixing ratio of gas and air is provided to the burner chamber 11 of the gas burner. The defined gas/air mixture is provided by mixing the air flow provided by an air duct 15 with a gas flow provided by a gas duct 16. The air flow and the gas flow become preferably mixed by a mixing device 23. Such a mixing device can be designed as a so-called Venturi nozzle. The quantity of the air flow and thereby the quantity of the gas/air mixture flow is adjusted by the fan 14, namely by the speed of the fan 14. The fan speed can be adjusted by an actuator 22 of the fan 14. The fan speed of the fan 14 is controlled by a gas burner control device 20 generating a control variable for the actuator 22 of the fan 14.

The defined mixing ratio of the defined gas/air mixture is controlled by the gas regulating valve 18, namely by a pneumatic controller 24 of the same. The pneumatic controller 24 of the gas regulating valve 18 controls the opening/closing position of the gas valve 18. The position of the gas valve 18 is adjusted by the pneumatic controller 24 on basis of a pressure difference between the gas pressure of the gas flow in the gas pipe 16 and a reference pressure. The gas regulating valve 18 is controlled by the pneumatic controller 24 in such a way that the pressure at the outlet of the gas valve 18 is equal to the reference pressure.

In FIG. 1, the ambient pressure serves as reference pressure. However, it is also possible to use the air pressure of the air flow in the air duct 15 as the reference pressure. The pressure difference between the gas pressure and the reference pressure is determined pneumatically by a pneumatic sensor of the pneumatic controller 24.

Alternatively, it is possible to determine the pressure difference between the gas pressure of the gas flow in the gas pipe and the reference pressure electronically by an electric sensor (not shown). In this case, the gas valve 18 would be controlled by an electronic controller, e.g. by the gas burner control device 20.

In any case, the mixing ratio of the defined gas/air mixture is controlled in such a way that over the entire modulation range of the gas burner the defined mixing ratio of the defined gas/air mixture is kept constant. A modulation of "1" means that the fan 14 is operated at maximum fan speed and thereby at full-load of the gas burner. A modulation of "5" means that the fan 14 is operated at 20% of the maximum fan speed and a modulation of "10" means that the fan 14 is operated at 10% of the maximum fan speed. By changing the fan speed of the fan 14 the load of the gas burner can be adjusted. Over the entire modulation range of the gas burner the defined mixing ratio of the defined gas/air mixture is kept constant.

The invention is not limited to the exemplary gas burner appliance shown in FIG. 1.

As described above, the gas burner appliance 10 uses a single electrode 13 serving as ignition electrode and as flame ionization electrode. The gas burner control device 20 of the gas burner appliance 10 however is as such adapted to act together with two separate electrodes, namely with an ignition electrode and flame ionization electrode provided by separate electrodes.

A gas burner controller adapter 25 allows to make use of such a combination of a single electrode 13 together with a gas burner control device 20 that is adapted to act together with two separate electrodes.

The gas burner controller adapter 25 comprises a first connection terminal 26 through which the same is connectable to a gas burner control device 20, namely to an input/output terminal 27 of the gas burner control device 20 that is adapted to receive a measurement signal of the electrode 13.

The gas burner controller adapter 25 further comprises a second connection terminal 28 through which the same is connectable to the gas burner control device 20, namely to an output terminal 29 of the gas burner control device 20 that is adapted to provide a first electrical voltage signal.

The gas burner controller adapter 25 further comprises a third connection terminal 30 through which the same is connectable to the gas burner control device 20, namely to another output terminal 31 of the gas burner control device 20 that is adapted to provide a second electrical voltage signal.

The first electrical voltage signal is higher than the second electrical voltage signal. The first electrical voltage signal may be in the range of 24V and the second electrical voltage signal may be at ground voltage level GND.

The first electrical voltage signal and the second electrical voltage signal are constant voltage level signals.

The gas burner controller adapter 25 further comprises a fourth connection terminal 32 through which the same is connectable to the single electrode 13 which is used as ignition electrode and in addition as flame ionization electrode. Another connection terminal 33 of the gas burner controller adapter 25 is connected to ground GND.

The gas burner controller adapter 25 further comprises a DC/DC converter 34 and an igniter 35 having a transfer coil 35*a* and an ignition coil 35*b*. Input terminals of DC/DC converter 34 are connected to the second connection terminal 28 and to the third connection terminal 30. Output terminals of the DC/DC converter 34 are connected to the transfer coil 35*a* of the igniter 35 through a capacitor 36 and through a thyristor 37. The ignition coil 35*b* of the igniter 35 is connected to the fourth connection terminal 32 and to the first connection terminal 26.

The cathode of the thyristor 37 is connected to one of the output terminals of the DC/DC converter 34. The anode of the thyristor 37 is connected to the transfer coil 35*a* of the igniter 35. The capacitor 36 in connected between the two output terminals of the DC/DC converter 34. Further on, the capacitor 36 is connected as well between the cathode of the thyristor 37 and the transfer coil 35*a* of the igniter 35.

The gas burner controller adapter 25 further comprises a fifth connection terminal 38 through which the same is connectable to the gas burner control device 20, namely to another output terminal 39 of the gas burner control device 20 that is adapted to provide a third electrical voltage signal. The third electrical voltage signal is preferably non constant but variable. The third electrical voltage signal is preferably alternating between the voltage level of the first electrical voltage signal and the voltage level of the second electrical voltage signal.

Figure 2:
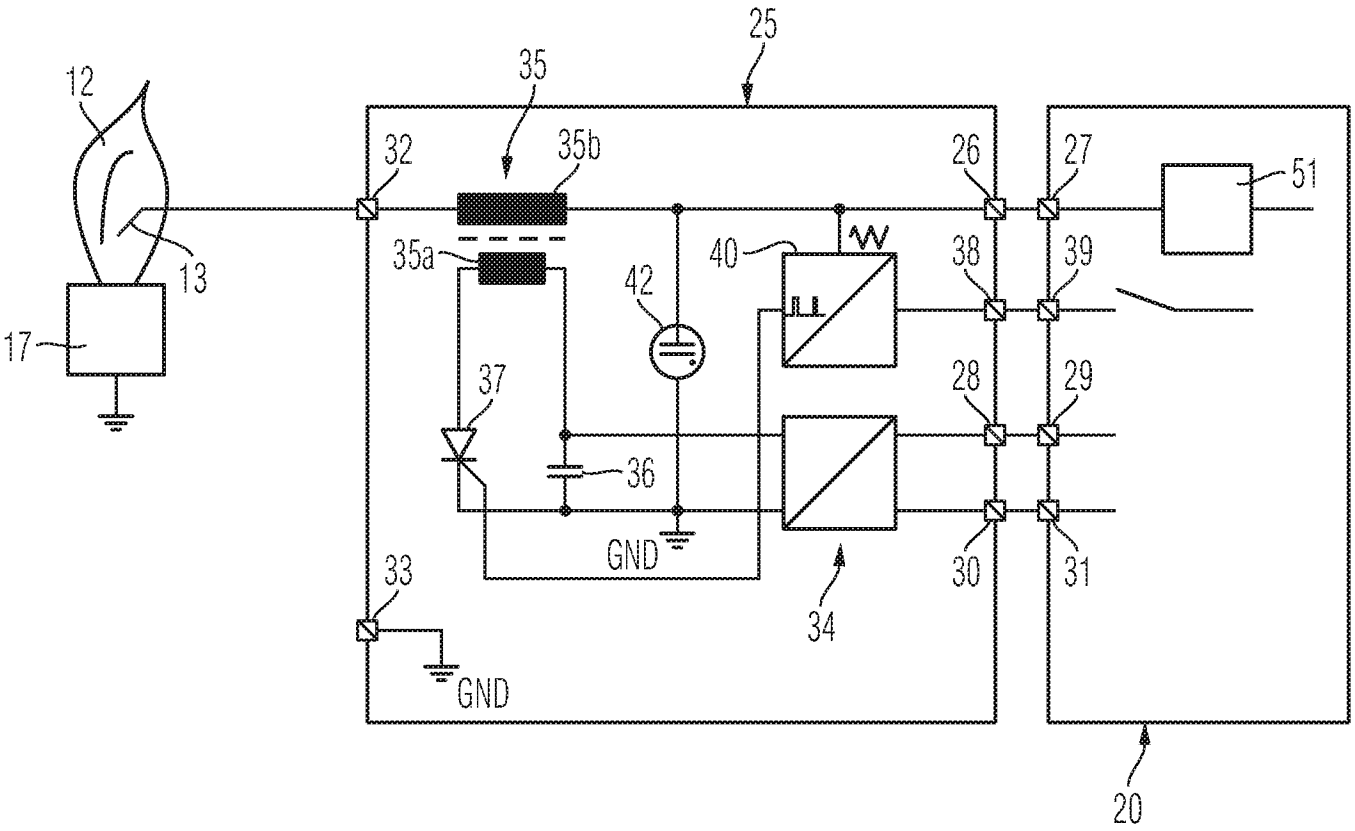
FIG. 2 shows a detail of the gas burner appliance, namely a gas burner controller adapter connected to a gas burner control device and to a single electrode used as ignition electrode and as flame ionization electrode.

In the embodiment show in FIG. 2, the fifth connection terminal 38 and the first connection terminal 26 are both connected to a synchronization circuit 40 through which the fifth connection terminal 38 is directly connected to a gate of the thyristor 37. The synchronization circuit 40 of the gas burner controller adapter 25 provides an output signal at the gate of the thyristor 37 in such a way that ignition pulses of the igniter 35 synchronizes to the zero-crossing of the flame ionization signal provided by single electrode 13. The synchronization circuit 40 may comprise a comparator and a monostable flip-flop.

Figure 3:
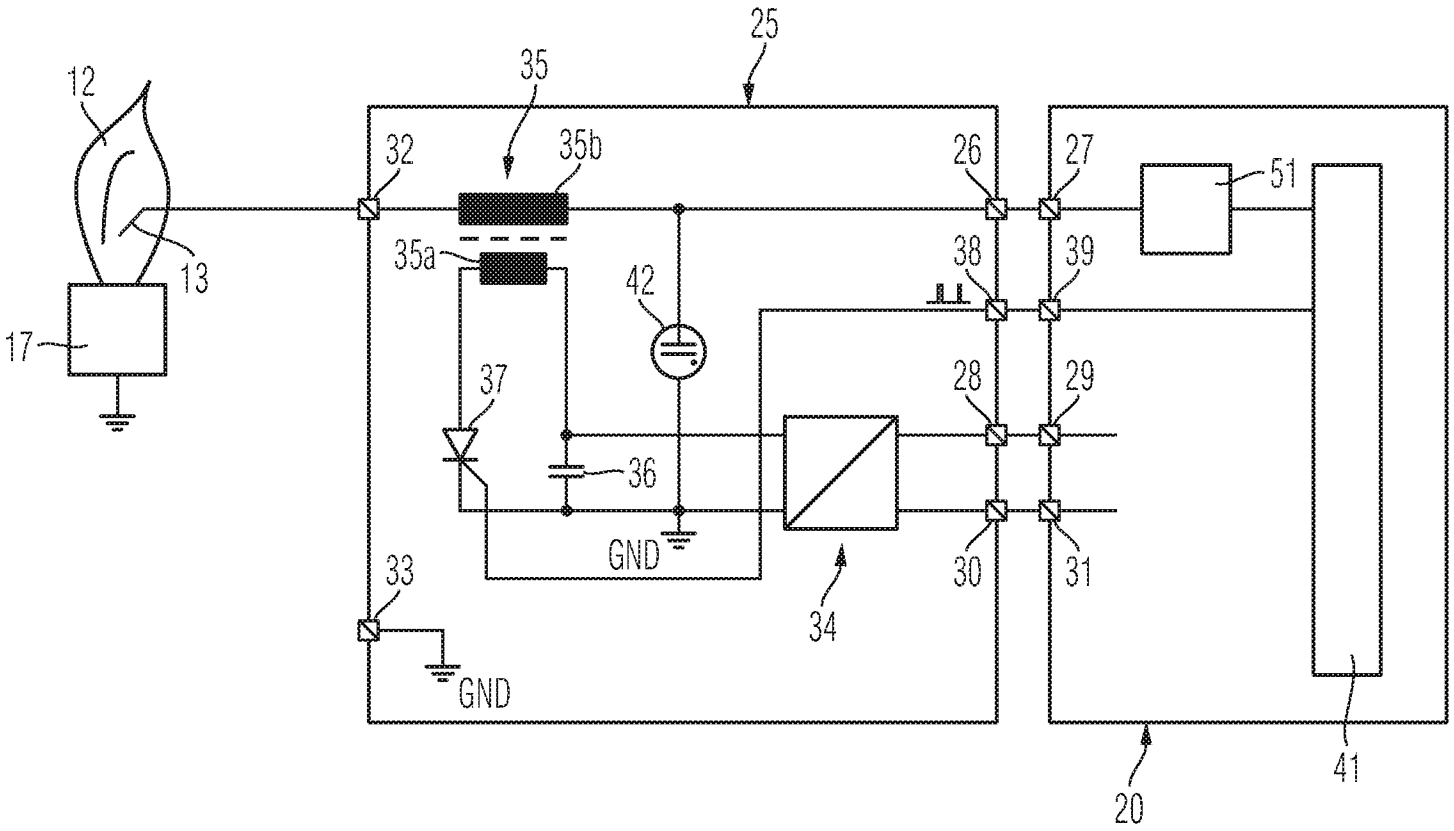
FIG. 3 shows an alternative detail of the gas burner, namely an alternative gas burner controller adapter connected to the gas burner control device and to the single electrode used as ignition electrode and as flame ionization electrode.

In the embodiment show in FIG. 3, the fifth connection terminal 38 of gas burner controller adapter 25 is directly connected to a gate of the thyristor 37. In the embodiment show in FIG. 3, the gas burner control device 20 comprises a microcontroller 41 that provides the synchronization signal for synchronizing the ignition pulses of the igniter 35 with the zero-crossing of the flame ionization signal provided by single electrode 13. The gas burner controller adapter 25 of FIG. 3 does therefore not comprise the synchronization circuit 40.

Preferably, the gas burner controller adapter 25 further comprises an overvoltage limiter 42 connected between the first connection terminal 26 and the output terminal of the DC/DC converter 34 to which the cathode of the thyristor 37 is connected. Said output terminal of the DC/DC converter 34 to which the cathode of the thyristor 37 is connected to ground GND. During ignition phases, the ignition coil 35*b* is connected to ground through an overvoltage limiter 42, namely when the ignition voltage is above a defined threshold. The overvoltage limiter 42 provides overvoltage protection at the input/output terminal 27 of the gas burner control device 20, namely for an amplifier/comparator circuit 51 of the gas burner control device 20 connected to the input/output terminal 27 of the gas burner control device 20. The input/output terminal 27 acts as output for a voltage provided by the amplifier/comparator circuit 51 and as input for the flame signal.

Such a gas burner controller adapter 25 allows use of a single electrode 13 to serve as a flame ionization electrode and as an ignition electrode in connection with a gas burner control device 20 that is adapted to act together with two separate electrodes.

With the gas burner controller adapter 25, a gas burner appliance installed in the field making use of two separate electrodes can be converted to a gas burner appliance making use of a single electrode 13 serving as a flame ionization electrode and as an ignition electrode.

The polarity of the mains voltage provided at the terminals 29, 31 or at the terminals 28, 30 has no effect on proper function. Further on, the energy of the ignition spark is completely independent from mains voltage and frequency, while it is generated from the DC/DC converter 34 with a constant output voltage.

Figure 4:
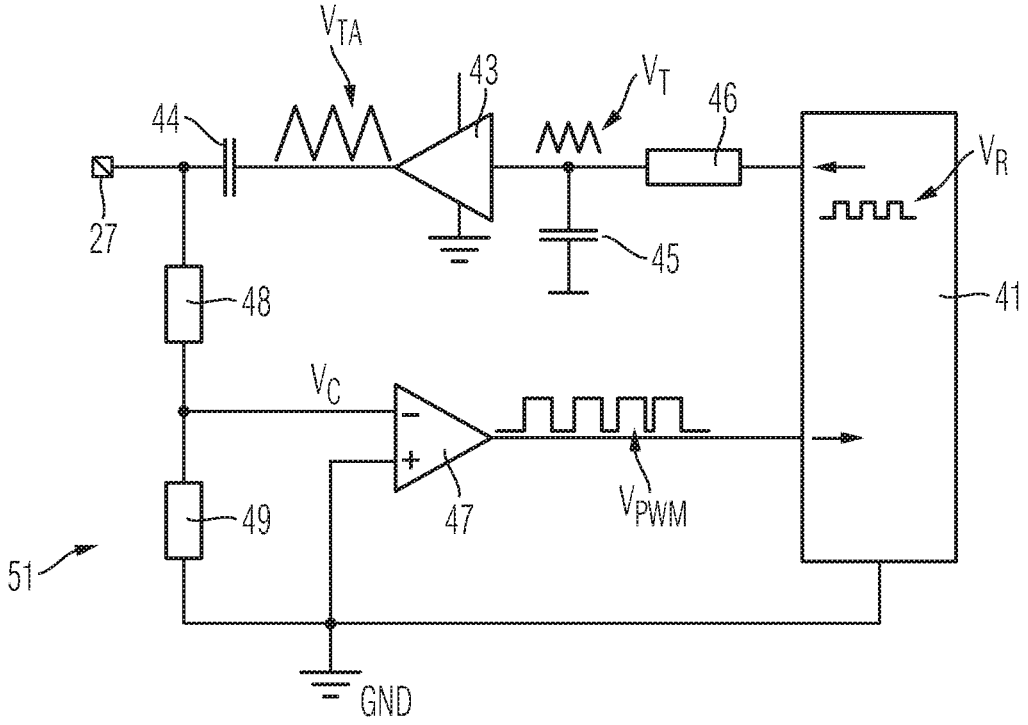
FIG. 4 shows a further detail of the gas burner appliance.

FIG. 4 shows details of the gas burner control device 20 of FIG. 3, namely details of the amplifier/comparator circuit 51.

The amplifier/comparator circuit 51 of the gas burner control device 20 is connected between the input/output terminal 27 of the gas burner control device 20 and the microcontroller 41 of the gas burner control device 20.

The amplifier/comparator circuit 51 comprises an amplifier 43. The amplifier 43 is connected in such a way between the input/output terminal 27 of the gas burner control device 20 and the microcontroller 41 of the gas burner control device 20 that a first capacitor 44 is connected between the input/output terminal 27 of the gas burner control device 20 and the amplifier 43 while a second capacitor 45 and a resistor 46 are connected between the amplifier 43 and an output terminal of the microcontroller 41, The microcontroller 41 provides at the output terminal of the same a rectangular voltage signal $V_R$.

The second capacitor 45 and the resistor 46 transform that rectangular voltage signal $V_R$ signal into a triangular voltage signal $V_T$. The amplifier 43 provides the amplified triangular voltage signal $V_{TA}$ at the first capacitor 44 at which also the flame ionization voltage from electrode 13 is provided. The amplified triangular voltage signal $V_{TA}$ and the voltage from electrode 13 provided at the input/output terminal 27 influence together the voltage $V_C$ across the first capacitor 44.

The amplifier/comparator circuit 51 further comprises a comparator 47, wherein the output of the comparator 47 is connected to an input terminal of the microcontroller 41. The voltage $V_C$ across the capacitor 44 is provided as first input voltage to the a first input terminal of the comparator 47 and the ground voltage level GND is provided as second input voltage to a second input terminal of the comparator 47. Resistors 48 and 49 are connected to the input terminals of the comparator 47, namely the resistor 48 between the first input terminal of the comparator 47 and the input/output terminal 27 of the gas burner control device 20 and the resistor 49 between the two input terminals of the comparator 47. The comparator 47 provides the PWM voltage signal $V_{PWM}$ to the input terminal of the microcontroller 41.

Figure 5:
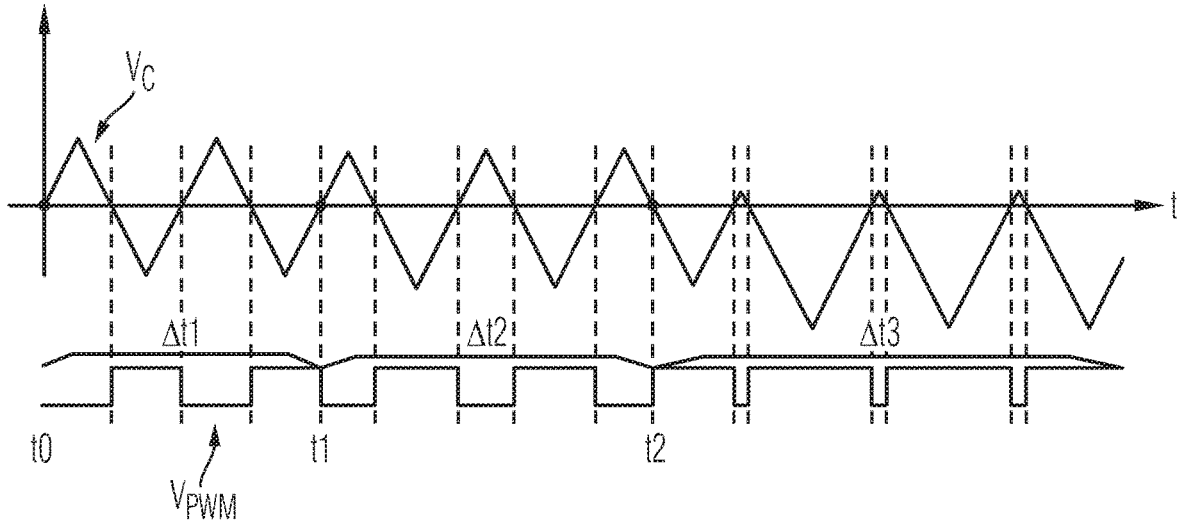
FIG. 5 shows a time diagram illustrating the method according to the present invention.
Figure 6:
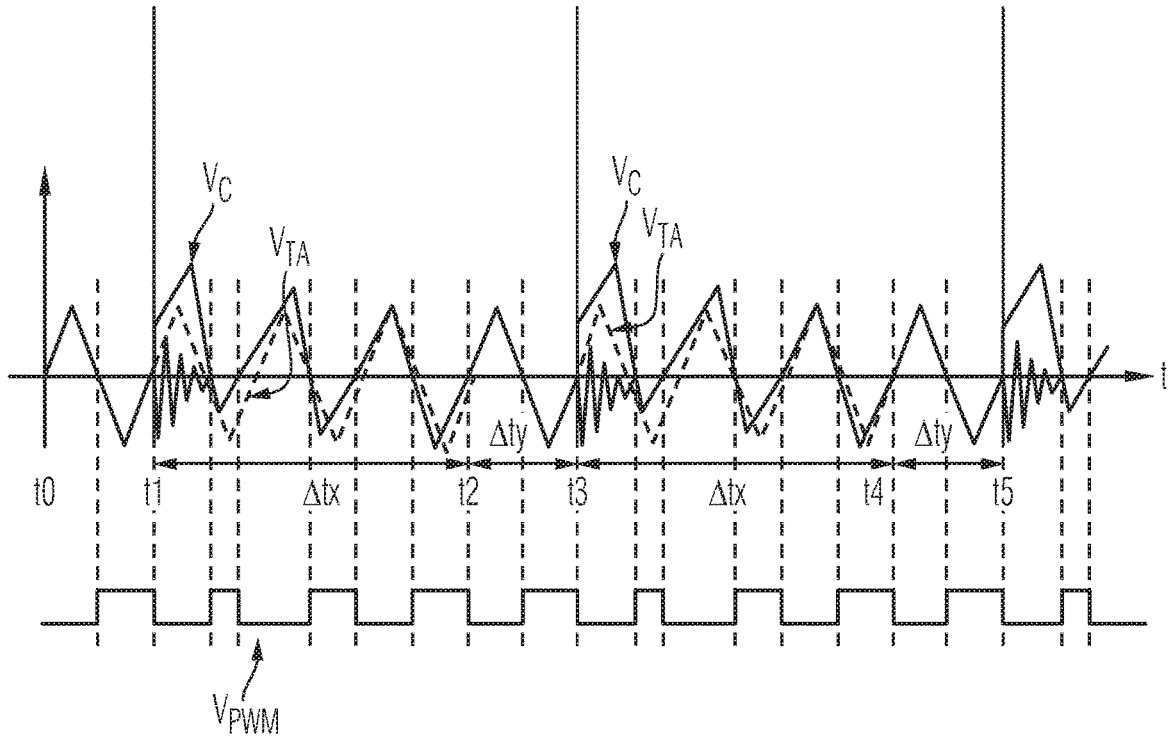
FIG. 6 shows another time diagram further illustrating the method according to the present invention.

FIGS. 5, 6 both show the voltage $V_C$ across the capacitor 44 as well as the PWM output voltage signal $V_{PWM}$ of the comparator 47 over the time t. FIG. 6 shows in addition the amplified triangular voltage signal $V_{TA}$ provided by the microcontroller 41 and by the amplifier 43.

FIG. 5 shows the voltage signals $V_C$ and $V_{PWM}$ without disturbance effects from an ignition. In the time interval Δt1 of FIG. 5 no flame 12 is present. The voltage signal $V_C$ corresponds to the amplified triangular voltage signal $V_{TA}$ and the duty cycle of the PWM voltage signal $V_{PWM}$ is 50%.

In the time interval Δt2 of FIG. 5 a flame 12 is present, the duty cycle of the PWM voltage signal $V_{PWM}$ is 60% corresponding to a relative small burner load of the gas burner appliance.

In the time interval Δt3 of FIG. 5 a flame 12 is present, the duty cycle of the PWM voltage signal $V_{PWM}$ is 80% corresponding to a relative high burner load of the gas burner appliance 10.

So, from the duty cycle of the PWM voltage signal $V_{PWM}$ the microcontroller 41 can detect if a flame 12 is present and can further detect the burner load of the gas burner appliance 10.

FIG. 6 shows the voltage signals $V_C$ and $V_{PWM}$ with disturbance effects from an ignition of the gas/air mixture caused by the igniter 35. At points of time t1, t3 and t5 of FIG. 6 ignition pulses are provided by the igniter 35, wherein said ignition pulses influence the voltage signals $V_C$ across the capacitor 44. In FIG. 6, the voltage signal $V_C$ across the capacitor 44 depend only from the amplified triangular voltage signal $V_{TA}$ provided by the microcontroller 41 and by the amplifier 43 and from the ignition pulsed provided by the igniter. In FIG. 6, the ignition pulses do not result into flames 12 and into a combustion. As can be seen from FIG. 6, after the time intervals Δtx the disturbance effects from the ignition are no longer present and the voltage signals $V_C$ across the capacitor 44 corresponds to the amplified triangular voltage signal $V_{TA}$ because no flame 12 is present.

Considering the above, the present application provides a method for operating the gas burner appliance 10.

During ignition phases of the gas burner appliance 10, the single electrode 13 is used as ignition electrode for igniting the gas/air mixture and as flame ionization electrode.

After each ignition spark which is provided by the electrode 13 a defined stabilization time in monitored, wherein the single electrode 13 is only used as flame ionization electrode during ignition phases after expiration of the stabilization time and before a next ignition spark occurs. Said stabilization time corresponds to the time intervals Δtx after which the disturbance effects from the ignition are no longer present in the voltage signal $V_C$ across the capacitor 44.

The duration of said defined stabilization time Δtx depends from the capacity of the capacitor 44 and from the resistance of the resistors 48, 49 connected between input/output terminal 27 of the gas burner control device 20 and the amplifier 43 and comparator 47 of the gas burner control device 20. The stabilization time Δtx is a fixed time interval stored within the microcontroller 41.

The output PWM signal $V_{PWM}$ of the comparator 47 is used to determine if a flame 12 is present and to determine burner load of the gas burner appliance 10. If the duty cycle of the output PWM signal $V_{PWM}$ of the comparator 47 after expiration of the stabilization time Δtx is 50%, no flame is present. If the duty cycle of the output PWM signal $V_{PWM}$ of the comparator 47 after expiration of the stabilization time Δtx is greater than 50%, a flame is present. The duty cycle of the output PWM signal $V_{PWM}$ of the comparator is indicative about the burner load.

LIST OF REFERENCE SIGNS

10 gas burner appliance
11 gas burner chamber
12 flame
13 electrode
15 air duct
16 gas duct
17 gas burner surface
18 gas valve/regulating valve
19 gas valve/safety valve
20 gas burner control device
21 exhaust duct
22 actuator
23 mixing device
24 pneumatic controller
25 gas burner controller adapter
26 first connection terminal
27 input/output terminal
28 second connection terminal
29 output terminal
30 third connection terminal
31 output terminal
32 fourth connection terminal
33 connection terminal
34 DC/DC converter
35 igniter
35*a* transfer coil
35*b* ignition coil
36 capacitor
37 thyristor
38 fifth connection terminal
39 output terminal
40 synchronization circuit
41 microcontroller
42 overvoltage protector
43 amplifier
44 capacitor
45 capacitor
46 resistor
47 comparator
48 resistor
49 resistor
50 heat exchanger
51 amplifier/comparator circuit

What is claimed is:

1. A gas burner controller adapter, comprising:

a first connection terminal configured to connect to an input/output terminal of a gas burner control device, wherein the input/output terminal is configured to receive a voltage signal of a flame ionization electrode;

a second connection terminal configured to connect to an output terminal of the gas burner control device, wherein the output terminal is configured to provide a first electrical voltage signal;

a third connection terminal configured to connect to another output terminal of the gas burner control device, wherein the another output terminal is configured to provide a second electrical voltage signal;

a fourth connection terminal configured to connect to a single electrode configured to be used as an ignition electrode and as the flame ionization electrode;

a DC/DC converter including input terminals; and an igniter having a transfer coil and an ignition coil, wherein the input terminals of the DC/DC converter are connected to the second connection terminal and to the third connection terminal and wherein a first output terminal of the DC/DC converter is connected to the transfer coil and a second output terminal of the DC/DC converter is connected to the transfer coil through a thyristor, and wherein a capacitor is connected between the first output terminal and the second output terminal of the DC/DC converter, and wherein the ignition coil of the igniter is connected to the fourth connection terminal and to the first connection terminal.

2. The gas burner adapter of claim 1, wherein a cathode of the thyristor is connected to the second output terminal of the DC/DC converter, and an anode of the thyristor is connected to the transfer coil of the igniter.

3. The gas burner adapter of claim 1, further comprising a fifth connection terminal configured to connect to an additional another output terminal of the gas burner control device, wherein the additional output terminal is configured to provide a third electrical voltage signal.

4. The gas burner adapter of claim 3, wherein the fifth connection terminal is directly connected to a gate of the thyristor.

5. The gas burner adapter of claim 3, wherein the fifth connection terminal and the first connection terminal are both connected to a synchronization circuit through which the fifth connection terminal is indirectly connected to a gate of the thyristor.

6. The gas burner adapter of claim 5, wherein the synchronization circuit provides an output signal at the gate of the thyristor in such a way that ignition pulses of the igniter are synchronized to a zero-crossing of the voltage signal provided by the single electrode.

7. The gas burner adapter of claim 5, wherein the synchronization circuit comprises a comparator and a monostable flip-flop.

8. The gas burner adapter of claim 1, further comprises an overvoltage limiter connected between the first connection terminal and the second output terminal of the DC/DC converter to which a cathode of the thyristor is connected.

9. The gas burner adapter of claim 1, wherein the capacitor is connected between the first output terminal and the second output terminal of the DC/DC converter, as well as between a cathode of the thyristor and the transfer coil of the igniter.

10. A gas burner appliance, comprising a burner chamber in which a gas/air mixture can be combusted;

an air pipe or air duct for providing the air of the gas/air mixture;

a gas pipe or gas duct for providing the gas of the gas/air mixture;

an exhaust pipe or exhaust duct through which exhaust flowing out of the burner chamber can be vented from the burner chamber;

a fan operably coupled to the exhaust pipe or to the air pipe;

a gas valve operably coupled to the gas pipe;

a single electrode serving as a flame ionization electrode and as an ignition electrode, wherein the ignition electrode is configured to ignite the gas/air mixture; and a gas burner control device configured to control operation of the gas burner appliance based on a voltage signal provided by the single electrode; and wherein the single electrode is connected to the gas burner control device by the gas burner adapter of claim 1.

11. A method for operating a gas burner appliance according to claim 10, wherein during ignition phases of the gas burner appliance, the single electrode is used as the ignition electrode for igniting the gas/air mixture and as the flame ionization electrode, wherein after an ignition spark is delivered via the single electrode, a defined stabilization time is initiated, wherein the signal provided by single electrode is only used as the flame ionization electrode for flame ionization measurements after the expiration of the defined stabilization time expires and before a next ignition spark is delivered.

12. The method of claim 11, wherein the duration of the defined stabilization time depends on the capacitance of a capacitor connected between the input/output terminal of the gas burner control device and an amplifier, and a resistor connected between the input/output terminal of the gas burner control device and an input of a comparator circuit of the gas burner control device.

13. The method of claim 12, wherein a voltage signal of the single electrode and a ground voltage signal are provided as input signals to the comparator circuit, wherein an output signal of the comparator is used to determine a burner load of the gas burner appliance.

14. A gas burner controller adapter for converting a gas burner control device, which is configured to work in conjunction with a flame ionization electrode and a separate ignition electrode, to work with a single electrode that functions as both a flame ionization electrode and an ignition electrode, the gas burner controller adapter comprising a first connection terminal for connection to a single electrode that functions as both a flame ionization electrode and an ignition electrode;

a second connection terminal for connection to a connection terminal of a gas burner control device;

an ignition coil operatively coupled between the first connection terminal and the second connection terminal, the ignition coil providing an operative connection between the first connection terminal and the second connection terminal to pass along a flame ionization signal generated by the single electrode to the second connection terminal; and an ignitor control block operatively coupled to one or more connection terminals of the gas burner controller adapter that are for connection to connection terminals of the gas burner control device, wherein the ignitor control block is configured to selectively activate the ignition coil to generate a spark signal at the first connection terminal sufficient to cause an ignition spark at the single electrode.

15. The gas burner controller adapter of claim 14, wherein the ignitor control block further includes a transfer coil operatively coupled to the ignition coil.

16. The gas burner controller adapter of claim 15, wherein the ignitor control block includes a charge pumping circuit, wherein the charge pumping circuit includes the transfer coil.

17. The gas burner controller adapter of claim 16, wherein the charge pumping circuit further comprises a switch and a capacitor, wherein the switch is operatively coupled to the capacitor, and the capacitor is operatively coupled to the transfer coil.

18. A gas burner controller adapter for converting a gas burner control device, which includes flame ionization terminals for interfacing with a flame ionization electrode and ignition terminals for interfacing with an ignition electrode, to work with a single electrode that functions as both a flame ionization electrode and an ignition electrode, the gas burner controller adapter comprising a first connection terminal for connection to a single electrode that functions as both a flame ionization electrode and an ignition electrode;

a plurality of second connection terminals for connection to the flame ionization terminals and the ignition terminals of the gas burner control device;

a control block configured for selectively generating a spark signal at the first connection terminal sufficient to cause an ignition spark at the single electrode based at least in part on one or more signals received from the ignition terminals of the gas burner control device; and the control block further configured for providing a flame ionization signal generated by the single electrode to one or more of the flame ionization terminals of the gas burner control device.

19. The gas burner controller adapter of claim 18, wherein the one or more signals received from the ignition terminals of the gas burner control device includes an AC signal.

20. The gas burner controller adapter of claim 19, wherein the spark signal is generated using an ignitor coil, a transfer coil, a capacitor and a switch, wherein the switch is controlled at least in part by the AC signal.

* * * * *